United States Patent [19]
Horton
[11] 4,210,817
[45] Jul. 1, 1980

[54] APPARATUS FOR ELIMINATING CROSS-FOGGING IN BIPLANE RADIOGRAPHY

[76] Inventor: Joseph A. Horton, 4817 Trinity Pl., Philadelphia, Pa. 19143

[21] Appl. No.: 2,199

[22] Filed: Jan. 9, 1979

[51] Int. Cl.[2] ..... G21G 11/00
[52] U.S. Cl. ..... 250/515; 250/505
[58] Field of Search ..... 250/505, 508, 509, 514, 250/272, 273, 274, 275, 439 R, 444, 445 R, 446, 447, 448, 449, 450, 451, 515, 516, 517, 518, 519, 520, 468, 511, 312–314

[56] References Cited

U.S. PATENT DOCUMENTS 2,770,719 11/1956 Simjian ..... 250/312

*Primary Examiner*—Alfred E. Smith
*Assistant Examiner*—Thomas P. O'Hare
*Attorney, Agent, or Firm*—Parmelee, Miller, Welsh & Kratz

[57] ABSTRACT

Film changers used in biplane radiography are provided with shields having radiolucent and radiopaque sections which are alternately disposed in front of the x-ray film presented by the film changers for exposure. Operation of the two shields is synchronized to dispose the radiopaque portion of one shield in front of one changer when the radiolucent portion of the other shield is disposed in front of the other changer such that scattered radiation cannot reach film in the one changer and fog it when an image is being recorded by the other changer. In one disclosed embodiment of the invention, the shield is a flexible endless belt with alternating radiopaque and radiolucent sections mounted for rotation in a loop around the film changer. In a second disclosed embodiment of the invention, planar discs having alternating radiopaque and radiolucent sectors are rotated in front of the film changers. In yet another embodiment of the invention, planar members, each having one radiopaque and one radiolucent section, are mounted for reciprocal movement in front of the film changers.

5 Claims, 4 Drawing Figures

APPARATUS FOR ELIMINATING CROSS-FOGGING IN BIPLANE RADIOGRAPHY

BACKGROUND OF THE INVENTION

1. Field of the Invention:

This invention relates to the art of taking x-ray pictures of a common object along two sight lines and, more particularly, to means for preventing cross-fogging of the x-ray pictures in such an arrangement.

2. Prior Art:

In a radiographic practice known as angiography, a radiopaque or contrast material is injected into the blood or lymphatic vessels of a patient and its progress through these vessels is observed by taking a series of x-ray pictures. The contrast materials currently used are toxic and, therefore, the amount injected into the patient must be limited. However, often it is necessary in this practice to obtain x-ray pictures in multiple projections, such as the front and side and so forth. In order to accommodate this requirement while minimizing both time of examination and the amount of contrast material used, pairs of x-ray tubes and film changers at right angles to each other have been used simultaneously, thus obtaining two orthogonal projections for each injection of contrast material.

It is well known that x-rays interact with the matter being x-rayed to produce scattering. This phenomenon, known as the Compton effect, produces noise on the x-ray film. While means have been devised to diminish the effect of scattered radiation on the primary film, namely the Potter-Bucky grid which is placed between the object being x-rayed and the film to absorb radiation which is not parallel to the line of sight of the picture, no attention has been focused on diminution of noise caused by scattered radiation from the second axis in a two axis angiogram.

It is a primary object of this invention to provide means to eliminate cross-fogging between the two axes of a two axis angiogram.

It is another object of this invention to eliminate such cross-fogging by means which are simple, reliable and inexpensive.

SUMMARY OF THE INVENTION

According to the invention, cross-fogging in biplane radiography is eliminated by shields having radiolucent and radiopaque portions which are alternately disposed in front of the film changers. Means are provided to synchronize the two shields such that the radiopaque portion of one shield is disposed in front of the film presented for exposure by its associated film changer when the radiolucent portion of the other shield is disposed in front of the film presented for exposure by the other film changer.

In one embodiment of the invention, the shield is in the form of a flexible endless belt having alternating radiolucent and radiopaque sections. The belt is mounted such that it forms a loop surrounding the film changer.

In another embodiment of the invention, the shield is a planar member mounted for movement in a plane parallel to the plane of the film presented for exposure. This shield may comprise a disc having alternating sectors of radiolucent and radiopaque material which is rotated in a plane parallel to and in front of the film or it may be a planar member having one radiopaque and one radiolucent section which is mounted for reciprocal movement in front of the film changer.

DESCRIPTION OF THE PREFERRED EMBODIMENTS

Figure 1:
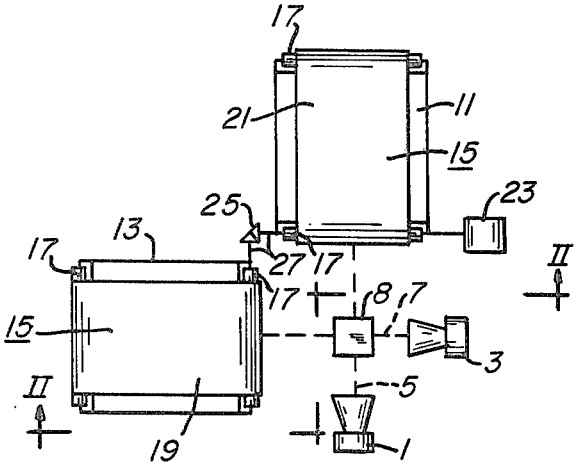
FIG. 1 is a plan view of apparatus in accordance with a first embodiment of the invention.
Figure 2:
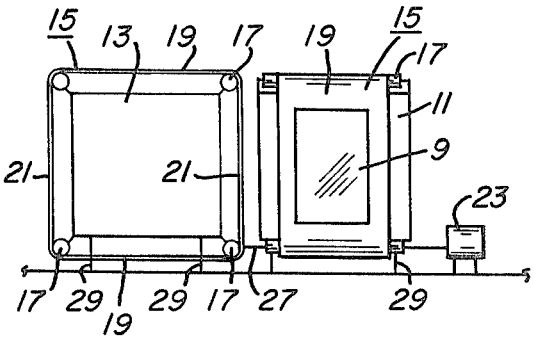
FIG. 2 is a vertical view of the embodiment of the invention shown in FIG. 1 taken along the line II—II.

Referring to FIGS. 1 and 2, two x-ray tubes 1 and 3 are arranged to project x-rays along two orthogonal sight lines 5 and 7 respectively. The x-rays from both tubes 1 and 3 pass through the object 8 to be x-rayed, which is normally a human or other living being. Frequently, although not necessarily, radiopaque contrast material has been injected into the blood or lymphatic vessels of the being in preparation for the radiograms.

The x-rays from the tube 1 project an image of the object 8 onto x-ray film presented for exposure in a window 9 by the film changer 11. Likewise, the x-rays from the tube 3 project a planar image of the object onto film presented for exposure by the film changer 13. The film changers 11 and 13 are commercial units which sequentially present cut or rolled film for exposure. These film changers are not provided with any sort of shutter so that it can be appreciated from observing FIG. 1 that while the radiation from x-ray tube 1 forms an image on film in changer 11, scattered radiation from tube 1 will also impinge upon the film in changer 13. Since this scattered radiation is random, fogging of the film in changer 13 occurs. In a similar manner, the film in changer 11 is fogged by scattered radiation emitted by the tube 3.

In order to eliminate this fogging, I propose that shields, which may take the form of flexible endless belts 15, be mounted for rotation about the changers 11 and 13 by rollers 17 at the four corners of the film changers. The belts 15 are comprised of alternate sections 19 and 21 of radiolucent and radiopaque materials respectively. The radiolucent sections may be made of plastic (e.g.) or pure rubber while the radiolucent sections may be made of lead impregnated rubber. The lower front roller 17 on changer 11 is rotated periodically by motor 23 to dispose sequentially the radiolucent sections 19 and radiopaque sections 21 in front of the window 9 in which x-ray film is presented for exposure. A pair of pinion gears 25 on the ends of the shafts 27 of the lower front rollers 17 of changers 11 and 13 synchronizes advancement of the belts 15 such that the radiopaque section 21 of the belt associated with changer 13 is in front of the film presented for exposure by that changer when the radiolucent section 19 is in front of the window 9 of changer 11 and vice-versa. Thus, when the x-ray tube 1 is energized to project an image onto the film presented for exposure by the film changer 11, the film presented by changer 13 is protected by the radiopaque portion 21 of the shield 15 and cannot be fogged by scattered radiation. The operation of the motor 23 can be automatically synchronized with the advancement of film by the film changers and energization of the x-ray tubes, if desired, or may be performed manually at the appropriate times.

While the belts 15 have been illustrated as circulating around the outside of the film changers which are raised by legs 29, the belt assembly could be enclosed by a cover and made an integral part of the changer. It will also be appreciated that the belts 15 could be mounted for rotation about a vertical axis, that is, with the belt circulating around the four sides of the changer, rather than about a horizontal axis as shown. It can further be appreciated that the belts can be driven by separate electrically synchronized motors rather than by a single motor with a mechanical coupling as shown.

Figure 3:
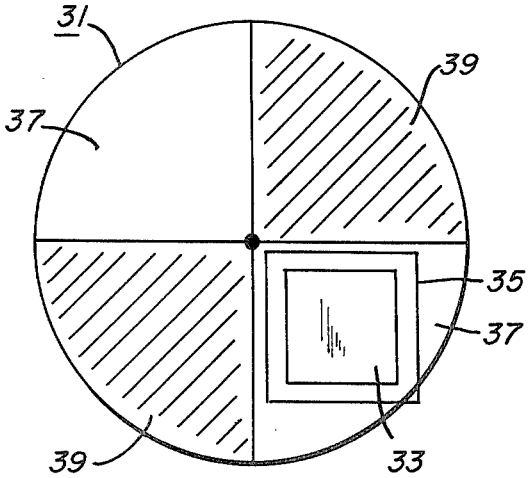
FIG. 3 is a vertical view of apparatus in accordance with a second embodiment of the invention.

FIG. 3 illustrates another embodiment of the invention in which the shield takes the form of a planar disc 31 mounted for rotation in front of the film 33 presented for exposure by the film changer 35. The disc 31 has alternating sectors 37 and 39 of radiolucent and radiopaque material respectively. As in the embodiment of FIGS. 1 and 2, rotation of the disc 31 may be synchronized mechanically or electrically with a similar disc mounted in front of a second film changer to place a radiopaque sector in front of one changer while a radiolucent section is in front of the other changer.

Figure 4:
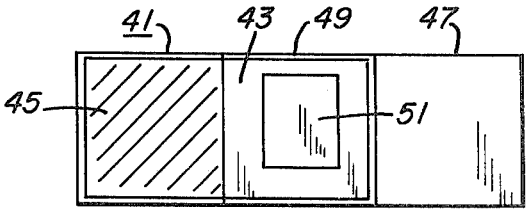
FIG. 4 is a front elevation view of apparatus in accordance with a third embodiment of the invention.

As illustrated in FIG. 4, the shield may also be a planar member 41 having one radiolucent section 43 and one radiopaque section 45 mounted for reciprocal motion in a frame 47 disposed in front of the film changer 49. With the shield in the full left position as shown in FIG. 4 the radiolucent section 43 is in front of the film changer so that x-rays may reach the film 51 presented for exposure. When the shield 41 is moved to the right as seen in FIG. 4, the radiopaque section 45 is disposed in front of the film changer 49 and the film 51 is protected from scattered radiation. Again, the operation of similar shields in front of each of the film changers can be synchronized mechanically or electrically to shield alternately one film changer while an image is being recorded on film in the other changer.

While the invention has herein been shown and disclosed in what is presently conceived to be the preferred embodiments, it is recognized that departures may be made therefrom within the scope of the invention, which is not limited to the details disclosed herein but is to be accorded the full scope of the appended claims as to any and all equivalents.

I claim:

1. An apparatus for practicing biplane radiography comprising first and second X-ray emitters arranged to direct x-rays through a common object along intersecting planes and first and second film changers for sequentially presenting film for exposure by x-rays generated by said first and second x-ray emitters respectively, the improvement for eliminating cross-fogging comprising:

first and second shielding means associated with the first and second film changers respectively, each said shielding means having radiolucent and radiopaque portions alternately disposed in front of the associated film changer to allow or block passage of x-rays to the film presented for exposure, respectively; and means for synchronizing the shield means to dispose the radiopaque portion of one shielding means in front of the film presented for exposure by its associated film changer when the radiolucent portion of the other shielding means is disposed in front of the film presented for exposure by its associated film changer.

2. The apparatus of claim 1 wherein at least one of said shielding means comprises a flexible endless belt having alternating radiolucent and radiopaque portions with said endless belt forming a loop which surrounds said film changer.

3. The apparatus of claim 1 wherein at least one of said shielding means comprises a planar member having adjacent radiolucent and radiopaque portions and mounted for movement in a plane parallel to the plane of the film presented for exposure.

4. The apparatus of claim 3 wherein said shielding means comprises a disc mounted for rotation in said plane parallel to the plane of the film presented for exposure and having alternating sectors of radiolucent and radiopaque material.

5. The apparatus of claim 3 wherein said shielding means comprises a planar member having one radiopaque and one translucent section mounted for reciprocal movement.

* * * * *